United States Patent [19]

Stewart

[11] Patent Number: 4,501,423

[45] Date of Patent: Feb. 26, 1985

[54] POOL GAME APPARATUS

[76] Inventor: Louie J. Stewart, 1056 Conway St., Billings, Mont. 59105

[21] Appl. No.: 522,102

[22] Filed: Aug. 11, 1983

[51] Int. Cl.[3] ..... A63F 7/00; A63F 7/24; A63F 7/34

[52] U.S. Cl. ..... 273/122 R

[58] Field of Search ..... 273/118-125, 273/129 S, 129 T, 355-357

[56] References Cited

U.S. PATENT DOCUMENTS

| | | | |
|---|---|---|---|
| 1,335,498 | 3/1920 | Harkinson | 273/124 R |
| 1,947,125 | 2/1934 | De Pew | 273/124 R |
| 2,062,166 | 11/1936 | Delwiche | 273/125 R |
| 2,062,204 | 11/1936 | Blackmore | 273/129 S |
| 2,370,050 | 2/1945 | La Rizza | 273/355 |
| 2,544,992 | 3/1951 | Jackson | 273/122 R |
| 3,865,376 | 2/1975 | Glass et al. | 273/125 A |

*Primary Examiner*—Paul E. Shapiro

*Attorney, Agent, or Firm*—Robert S. Smith

[57] ABSTRACT

A game board apparatus which includes an inclined top deck, a cue ball and a first ball, and apparatus for holding the first ball on the inclined top deck. The apparatus for holding exposes the first ball to impact from a cue ball when the cue ball is driven up the inclined deck and allows physical movement of the first ball up the inclined top deck. The invention also includes apparatus for driving the cue ball up the inclined top deck toward the first ball.

4 Claims, 6 Drawing Figures

POOL GAME APPARATUS

BACKGROUND OF THE INVENTION

The invention relates to game apparatus and particularly to game apparatus employing one or more balls. The prior art includes numerous games utilizing balls such as Stark U.S. Pat. No. 2,240,871, which shows a ball driving apparatus which pivots about an axis which is parallel to the game surface. Shoemaker U.S. Pat. No. 3,985,355 shows balls of various colors and Craig U.S. Pat. No. 2,710,755 shows arms which directs balls toward the driver mechanism in which the arms and driver do not apparently pivot in any way.

It is an object of the present invention to provide a novel game apparatus which will be entertaining and challenging.

It is another object of the invention to provide apparatus which will require skills not required in other game apparatus which has been generally known.

SUMMARY OF THE INVENTION

The foregoing objects and other objects and advantages which shall become apparent from the detailed description of the preferred embodiment are attained in an apparatus which includes a game board apparatus, which includes an inclined top deck, a first ball and a second or cue ball, and means for holding the first ball on the inclined top deck. The means for holding exposes that ball to impact from the cue ball when the cue ball is driven up the inclined top deck and allows physical movement of the first ball up the inclined top deck. The apparatus also includes means for driving the cue ball up the inclined top deck toward the first ball.

The means for driving may include elongated spring bias means which is pivotally mounted on the inclined top deck about an axis which is substantially perpendicular to the inclined top deck to allow an operator to direct the travel of the cue ball. The elongated spring bias means for driving may have arms extending respectively to each side thereof. The apparatus may further include upstanding walls extending between the means for holding and the means for driving, the cue ball being constrained by the walls. Thus, these walls, the means for driving and the means for holding limit possible positions of the cue ball to points intermediate the means for driving, the means for holding and the walls. The apparatus may also include an inclined ball guide having a plurality of predefined tracks in the upper face thereof. The top deck may have at least one opening disposed at a higher elevation than the means for holding. The apparatus may further include indicia associated with each of the predefined tracks for scoring and a plurality of additional balls cooperating with the means for holding.

BRIEF DESCRIPTION OF THE ACCOMPANYING DRAWING

The invention will be better understood by reference to the accompanying drawing in which.

BRIEF DESCRIPTION OF THE PREFERRED EMBODIMENT

Figure 1:
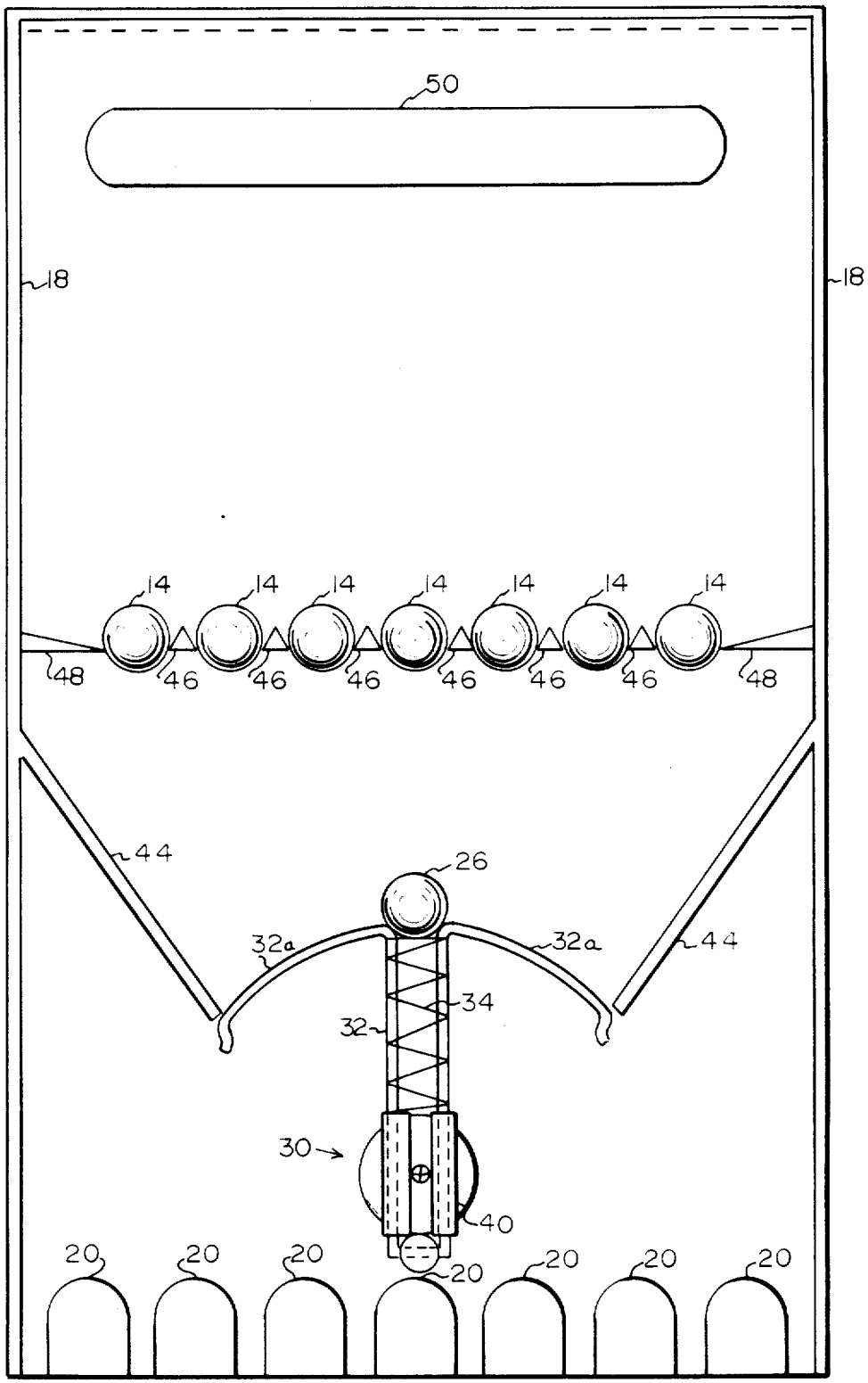
FIG. 1 is a plan view of the apparatus in accordance with one form of the invention.
Figure 2:
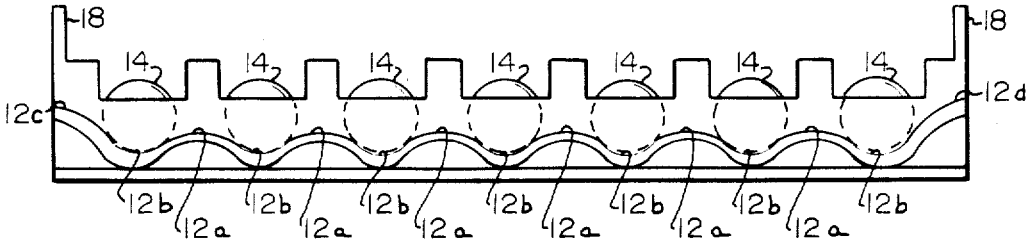
FIG. 2 is an end view of the apparatus illustrated in FIG. 1.
Figure 3:
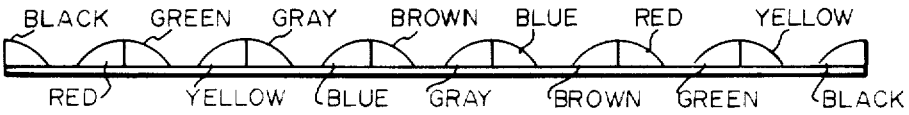
FIG. 3 is a color chart represented schematically, which is disposed on the front end (left end as viewed) of the apparatus illustrated in FIG. 2.

Referring now to FIGS. 1–6, there is shown a game which includes a rear wall 10*a*, a ball guide 12, and a top deck 16. A bottom member 10 has a generally planar portion and the upstanding rear wall 10*a*. The rear wall 10*a* has two ledges 10*b* and 10*c*. The ball guide 12 is generally planar and rests on the ledge 10*b* at one end thereof and at the opposite end on the upper face of the bottom member 10. On the top face of the ball guide 12 are ridges 12*a* and valleys 12*b* that extend in mutually parallel relationship the full length of both the game and the ball guide 12. Referring specifically to FIG. 3, there is shown the front end view of the game. It can be seen that in this view the ridges 12*c* and 12*d* on each outer side of the ball guide 12 extend upward much higher than the other ridges 12*a*. The higher ridges 12*c* and 12*d* are provided to prevent a ball 14 from bouncing off the ball guide 12, as will be apparent from the subsequent description.

Figure 4:
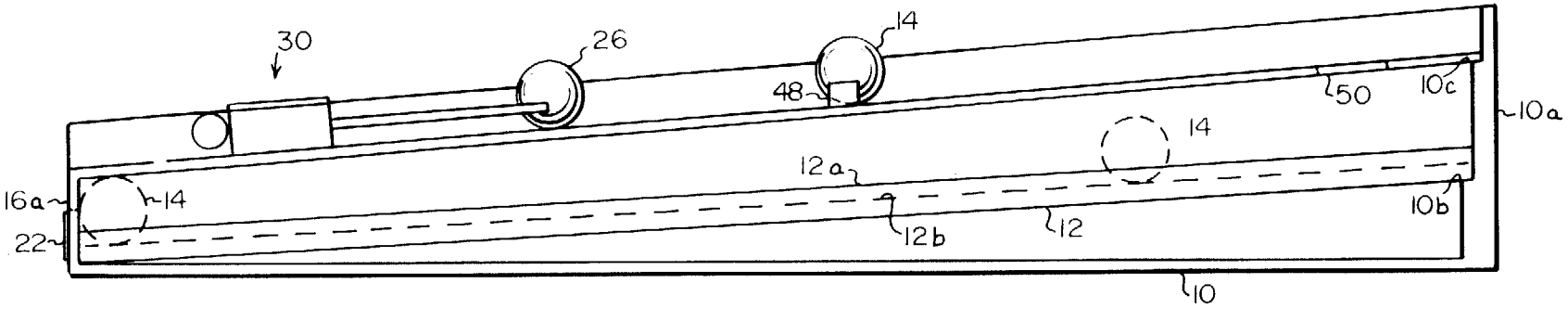
FIG. 4 is a side view of the apparatus illustrated in FIGS. 1 and 2.

Carried on the ledge 10*c* is the generally planar top deck 16, as best seen in FIG. 4. Extending along opposed two sides of the top deck 16 are railings 18. The upper extremity of the rear wall 10*a* extends between the railings 18. The front end of the top deck 16 has no railing 18. Ordinarily, the top deck 16 is opaque, since this lends more excitement to the game.

The top deck 16 extends on a slant towards the front end of the game. At the front end it has a depending portion 16*a* which rests on the bottom member 10 in front of the ball guide 12. In FIG. 1 it will be seen that the top deck 16 has seven ball removal slots 20. The slots 20 extend from the top deck 16 and extend downward into the front end, defined by the depending portion 16*a*. From these slots 20 will be taken the balls 14 that come to rest in front of a color chart 22. (To be described later.)

Figure 5:
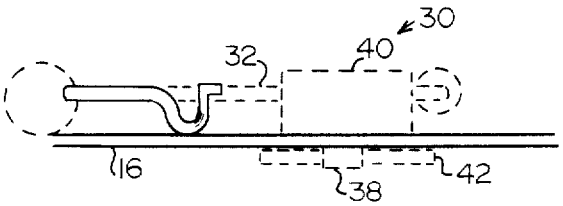
FIGS. 5 and 6 are partially schematic views illustrating the illustrated different aspects of the driving mechanism.
Figure 6:
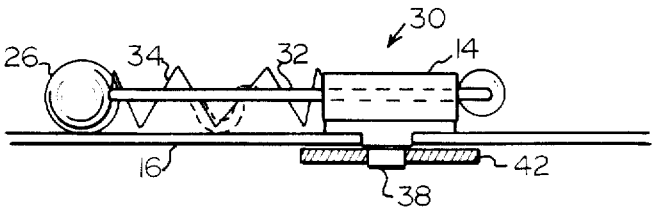

Mounted on the upper face of the top deck 16 is a ball driving mechanism 30, which is for the purpose of shooting a cue ball 26. The ball driving mechanism 30 includes a spring shaft 32 made of wire and bent in a U-shape with two ends extending outwardly to define arm guides 32*a*. The U-shaped spring shaft 32 has a wire spring 34 curled around it. Near the front end of the spring shaft 32 is a pivot 38, as best seen in FIGS. 5 and 6. The spring shaft 32 is mounted on the pivot 38 with a spring shot guide 40. A pivot nut 42 secures the pivot 38 to the top deck 16.

Disposed at one end of the ball driving mechanism 30 is a cue ball 26 which is shown positioned ready for shooting.

On either side of the ball driving mechanism 30 is a wing wall 44. The wing walls 44 direct the cue ball 26 back to the arm guides 32*a* after being shot.

In front of the cue ball 26 are the seven different colored balls 14. The balls 14 are held in position by ball restraints or holders 46, 48 mounted on the top deck 16 and which allow impact between the cue ball 26 and one side of any ball 14 when the ball 14 is construed by the holders 46, 48. The holders 46, 48 are approximately ¼" high and they prevent the balls 14 from rolling further down the top deck 16. Further up the top deck 16 from the seven colored balls 14 is an oblong slot 50.

Play is begun by shooting the cue ball 26 from the ball driving mechanism 30 and attempting to hit one of the colored balls 14 and to knock it into the oblong slot 50. If the shot is successful and goes into the slot 50, it falls to the ball guide 12 below. The ball 14 will roll off a ridge 12*a* and follow a valley 12*b* to the front of the game. Thus, the ball 14 will come to rest behind the front end and the color chart 22 shown in FIG. 3 will show if that individual ball 14 scores plus 15 or minus 5. (It will be understood that only seven balls 14 are included in the game and that the seven balls 14 have been shown in both FIGS. 1 and 2 to illustrate the positions at both the beginning of play as well as after play is completed by any one player.) The color chart 22 is placed at the front end of the game so that a ball 14 at rest is disposed next to two markers having two colors displayed next to it. For example, if a red ball 14 rests in the extreme left valley 12*b* shown in FIG. 2 and, thus, in front of the red and black markers on the color chart 22, that red ball 14 scores plus 15 points. If the red ball 14 had come to rest in front of the brown and blue markers, it would have scored minus 5.

For descriptive purposes, an imaginary game between Player A and B will be described. Player A shoots first. By agreement the game will continue until one player attains 100 points. Player B has the privilege of placing the seven colored balls 14 at the holders 46, 48. He endeavors to place the balls 14 in the most disadvantaged positions possible for making a plus score. Player A pulls the spring shaft 32 back, aims and sends the cue ball 26 forward. It strikes the red ball 14 (one of the balls 14) propelling it into the slot 50. The red ball 14 falls to the ball guide 12 below where it rolls off a ridge 12*a* and follows one of the valleys 12*b* to the front or lower end. The ball 14 comes to rest behind the color chart 22. If the ball 14 comes to rest in the valley 12*b* behind the red and green marker shown on the color chart 22, the red ball 14 matching the red on the marker has scored plus 15 points.

Scoring and a sample score sheet for players A and player B will now be described. Player A, with a score of plus 15 points does not mark up his points on the score sheet until he has completed play with all seven balls 14.

Player A resumes play with the rest of the seven balls 14. Player A shoots again and the green ball 14 is the object. It goes into the slot 50 and comes to rest in front of the green and yellow marker on the color chart 22. Thus, the green ball 14 scores a plus 15.

Player A resumes shooting and his next play is a brown ball 14. It lands in front of black and yellow marker on the color chart 22 for a score minus 5. Player A continues to play until the remainder of the balls yellow, blue, grey and black 14 are in scoring positions, as shown in FIG. 2. Now player A can tally his points on the score sheet. By looking at the score sheet it can be seen how player A scored. Player A then retrieves the seven colored balls 14 from the ball removal slots 20 and places them in the most disadvantaged positions behind the holders 46, 48.

Player B starts his play by shooting the green ball 14 into the slot 50 and it comes to rest behind the green and red marker on the color chart 22 scoring plus 15 points. His second shot, a brown ball 14, comes up behind the grey and blue marker on the chart 22 for a minus 5. Player B's third shot, a red ball 14 comes to rest behind the black and red marker for a plus 15 score. The fourth shot by player B places the yellow ball 14 behind the red ball 14. The red ball 14 rests behind the red and black marker. Thus, the yellow ball 14 in this position cancels out the red ball's plus 15. Refer to score sheet for this tally.

Player B continues play with the three remaining balls 14, grey, blue and black. It can be seen on the score sheet below that player A is plus 15 points ahead at the first round. A round is a seven ball run off by each player.

This game by A and B will continue until one or the other player gets to an agreed upon 150 points. That player will be the winner.

If it is a condition of play after the cue ball 26 is shot, a player must manipulate the ball driving mechanism 30 so as to retrieve the cue ball 26 on its return from a shot. In other words, the ball driving mechanism 30 must be pivoted about the pivot 38 so as to "catch" the cue ball 26 in preparation for the next shot.

| Color of Ball | Sample Score Sheet: 10 points plus | 10 points minus |
|---|---|---|
| | Player A | |
| Red | 15 | |
| Blue | | 5 |
| Green | 15 | |
| Yellow | 15 | |
| Grey | | 5 |
| Black | | 5 |
| Brown | 15 | |
| Total | 60 | 15 |
| First Round | 45 | |
| | Player B | |
| Red | | |
| Blue | 15 | |
| Green | 15 | |
| Yellow | | 5 |
| Grey | 15 | |
| Black | | 5 |
| Brown | | 5 |
| First round | 45 | 15 |

Although the ball restraints or holders 46, 48 have been described in terms of fixed members which are spaced apart to allow a ball 14 to extend partially between them and which are contoured to allow movement of the ball 14 upwards along the inclined top deck 16, it will be understood that alternative constructions might be employed. For example, a flexible membrane may be used to hold the balls 14 while a cue ball 26 is driven into them to urge them towards the slot 50. The membrane might alternatively be a single membrane holding all of the balls 14 or a plurality of discrete membranes. Various other techniques may also be employed for transferring energy between the cue ball 26 and one of the balls 14 without relying on the specific restraint or holder 46, 48 ilustrated in the drawing.

The invention has been described with reference to its illustrated preferred embodiment. Persons skilled in the art of constructing games, may upon exposure to the teachings herein, conceive variations in the mechanical development of the components therein. Such variations are deemed to be encompassed by the disclosure, the invention being delimited only by the appended claims.

Having thus described my invention, I claim:

1. A game board apparatus, which comprises:

an elongated inclined top deck having a plurality of sides;

first and second balls;

means for holding said first ball on said elongated inclined top deck, said means for holding allowing physical movement of said first ball up said elongated inclined top deck and exposing said first ball to impact from said second ball when said second ball is driven up said elongated inclined top deck;

means for driving said second ball up said elongated inclined top deck toward said first ball;

elongated first and second guide means disposed on said elongated inclined top deck, said elongated first and second guide means converging downwardly toward said means for driving; and said means for driving comprising an assembly mounted for pivotal movement about an axis which is substantially perpendicular to said elongated inclined top deck, said assembly including means for holding said second ball utilizing only gravity, an elongated spring bias means and arms extending laterally of and independently of said means for holding said second ball to allow an operator to direct the direction of travel of said second ball and control the position of said arms, said arms being pivotable between a first position where they block an opening between the lower extremity of said first and second elongated guide means and a second position where they do not.

2. The apparatus as described in claim 1, further including:

an inclined ball guide having a plurality of predefined tracks in the upper face thereof; and wherein said elongated inclined top deck has at least one opening disposed at a higher elevation than said means for holding.

3. The apparatus as described in claim 2, further including:

indicia associated with each of said predefined tracks for scoring.

4. The apparatus as described in claim 3, further including:

a plurality of additional balls cooperating with said means for holding.

* * * * *